US006434856B1

(12) United States Patent
Ensign et al.

(10) Patent No.: US 6,434,856 B1
(45) Date of Patent: Aug. 20, 2002

(54) VARIABLE WET FLOW RESISTANCE DRYING APPARATUS, AND PROCESS OF DRYING A WEB THEREWITH

(75) Inventors: Donald Eugene Ensign, Cincinnati; Michael Gomer Stelljes, Jr., West Chester; Paul Dennis Trokhan, Hamilton; Osman Polat, Montgomery, all of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/929,589

(22) Filed: Aug. 14, 2001

(51) Int. Cl.[7] ..... F26B 3/00; F26B 5/14

(52) U.S. Cl. ..... 34/444; 34/399; 34/115; 34/125; 34/453

(58) Field of Search ..... 34/397, 398, 399, 34/114, 115, 117, 125, 419, 420, 421, 452, 453, 456, 581, 582, 444

(56) References Cited

U.S. PATENT DOCUMENTS

| | | | | | |
|---|---|---|---|---|---|
| 3,301,746 | A | * | 1/1967 | Sanford | 162/113 |
| 3,905,863 | A | * | 9/1975 | Ayers | 162/113 |
| 3,974,025 | A | * | 8/1976 | Ayers | 162/113 |
| 4,191,609 | A | * | 3/1980 | Trokham | 162/113 |
| 4,556,450 | A | | 12/1985 | Chuang et al. | |
| 5,274,930 | A | | 1/1994 | Ensign et al. | |
| 5,437,107 | A | * | 8/1995 | Ensign et al. | 34/117 |
| 5,539,996 | A | * | 7/1996 | Ensign | 34/115 |
| 5,581,906 | A | | 12/1996 | Ensign et al. | |
| 5,584,126 | A | | 12/1996 | Ensign et al. | |
| 5,584,128 | A | * | 12/1996 | Ensign et al. | 34/117 |
| 5,598,643 | A | | 2/1997 | Chuang et al. | |
| 5,625,961 | A | * | 5/1997 | Ensign et al. | 34/117 |
| 5,699,626 | A | | 12/1997 | Chuang et al. | |
| 5,701,682 | A | | 12/1997 | Chuang et al. | |
| 5,938,893 | A | | 8/1999 | Trokhan et al. | |
| 5,942,322 | A | | 8/1999 | Ensign et al. | |
| 6,021,583 | A | | 2/2000 | Stelljes, Jr. et al. | |
| 6,105,276 | A | | 8/2000 | Ensign et al. | |

FOREIGN PATENT DOCUMENTS

| | | |
|---|---|---|
| WO | WO 99/53136 | 10/1999 |

* cited by examiner

*Primary Examiner*—Ira S. Lazarus
*Assistant Examiner*—K. B. Rinehart
(74) *Attorney, Agent, or Firm*—David K. Mattheis; David M. Weirich; Ken K. Patel

(57) ABSTRACT

A micropore drying apparatus having a variable wet flow resistance. The flow resistance preferably decreases in the machine direction. The micropore drying apparatus may comprise a single integral unit having an decreasing wet flow resistance from the beginning to the end of the unit. Alternatively, the micropore drying apparatus may comprise a plurality of discrete units, each unit having a successively lesser flow resistance than that of the preceding unit. Alternatively, a hybrid arrangement may be used wherein each discrete unit has a successively decreasing flow resistance within that unit. The micropore drying apparatus may comprise one or more micropore drying media. The micropore drying media have pores which allow air flow therethrough. The pores are disposed in a grid, to form a field of pores. The decreasing flow resistance may preferably be provided by adjusting one or more of said pores, which affect the flow resistance through a single pore or through the entire field of the pores.

19 Claims, 2 Drawing Sheets

VARIABLE WET FLOW RESISTANCE DRYING APPARATUS, AND PROCESS OF DRYING A WEB THEREWITH

FIELD OF INVENTION

The subject invention relates to through air drying for tissue paper papermaking, and more particularly to through air drying usable with micropore drying media.

BACKGROUND OF THE INVENTION

Micropore drying media are known in the art. Micropore drying media include a ply, or a plurality of plies superimposed in face-to-face relationship. The plies provide restrictions in the flow path for air flow therethrough. The restrictions in the flow path may comprise pores smaller than many of the interstitial areas in tissue paper, as well as other generally planar materials dried, or otherwise made, thereon. The following discussion is directed to tissue paper, it being understood that the invention is not so limited.

By providing pores smaller than the interstices of the tissue paper, differences in flow resistance through the tissue paper, etc., are negated due to the greater flow resistance being provided by the micropore drying medium. Such differences in flow resistance may occur due to differences in intensive properties, such as caliper, basis weight and density. Typically, such differences occur on a very small scale due to localized differences in the various regions of the tissue paper.

The prior art discloses micropore media suitable for drying tissue paper thereon. Improvements to the micropore media include micropore drying apparatus having multiple zones, high fatigue strength/low pressure drop micropore drying media and micropore media having preferentially reduced wet pressure drop. Such micropore media, suitable for adaptation to the present invention, are illustrated in commonly assigned U.S. Pat. No. 5,274,930, issued Jan. 4, 1994 to Ensign et al.; U.S. Pat. No. 5,437,107, issued Aug. 1, 1995 to Ensign et al.; U.S. Pat. No. 5,539,996, issued Jul. 30, 1996 to Ensign et al.; U.S. Pat. No. 5,581,906, issued Dec. 10, 1996 to Ensign et al.; U.S. Pat. No. 5,584,126, issued Dec. 17, 1996 to Ensign et al.; U.S. Pat. No. 5,584,128, issued Dec. 17, 1996 to Ensign et al.; U.S. Pat. No. 5,625,961, issued May 6, 1997 to Ensign et al.; U.S. Pat. No. 5,912,072, issued Jun. 15, 1999 to Trokhan et al.; U.S. Pat. No. 5,942,322, issued Aug. 24, 1999 to Ensign et al.; U.S. Pat. No. 6,021,583, issued Feb. 8, 2000 to Stelljes, Jr. et al.; and U.S. Pat. No. 6,105,276, issued Aug. 22, 2000 to Ensign et al., which patents are incorporated herein by reference.

There remain other ways to optimize energy consumption when using micropore drying techniques. For example, as water is removed from the tissue paper, etc., to be dried by air flow therethrough, subsequent flow restrictions in the micropore media need not be as great. Thus, in the machine direction, flow restrictions in the micropore media may be reduced while maintaining a pore size smaller than many, preferably most, and most preferably all, of the interstices in the tissue paper.

Thus, flow restrictions through the micropore media may be reduced as the tissue paper to be dried travels across the micropore drying medium in the machine direction. This arrangement provides the benefit of decoupling mechanical dewatering of the tissue paper from through air drying of the tissue paper. During mechanical dewatering, a small pore size is better to promote dewatering by capillary action. During through air drying, pore sizes which are relatively larger, but still provide a limiting orifice for air flow through the tissue paper, have less flow resistance and thereby save energy.

Reduced flow resistance through the micropore media may be provided by having pore sizes which successively increase in the machine direction. Alternatively, micropore media having a higher density of pores, i.e., more pores per square centimeter, in the machine direction may be utilized. Finally, hybrid media having both of the above features may be utilized. Furthermore, the reduced flow resistance apparatus of the present invention may be used with through air drying tissue paper papermaking processes which are not limited to micropore drying media. The variable flow resistance apparatus and process according to the present invention may be applied to other through air drying tissue paper papermaking techniques as well. For example, the disclosed apparatus and process may be used with the predryers of a through air drying tissue paper papermaking machine.

SUMMARY OF THE INVENTION

The invention comprises a micropore drying apparatus having a machine direction and a Z-direction orthogonal thereto. The micropore drying apparatus is permeable to air flow therethrough. The micropore drying apparatus has a wet flow resistance to air flow therethrough, which wet flow resistance to air flow decreases in the machine direction of the micropore drying apparatus.

The micropore drying apparatus has a grid of pores which provide the air flow therethrough. The wet flow resistance may decrease in either a step wise fashion or in a gradient. The decrease may occur within sections of, or entirely throughout, the drying apparatus. The decreased flow resistance may be achieved by increasing the size and/or number of pores. In yet another embodiment, the decreasing pore resistance may be provided by coating the micropore drying apparatus to reduce the surface energy, or changing the flow path through the pores to be less tortuous and provide a lesser flow resistance in the Z-direction. In yet another embodiment, the hydraulic radius of the pores may be reduced.

DETAILED DESCRIPTION OF THE INVENTION

Figure 1:
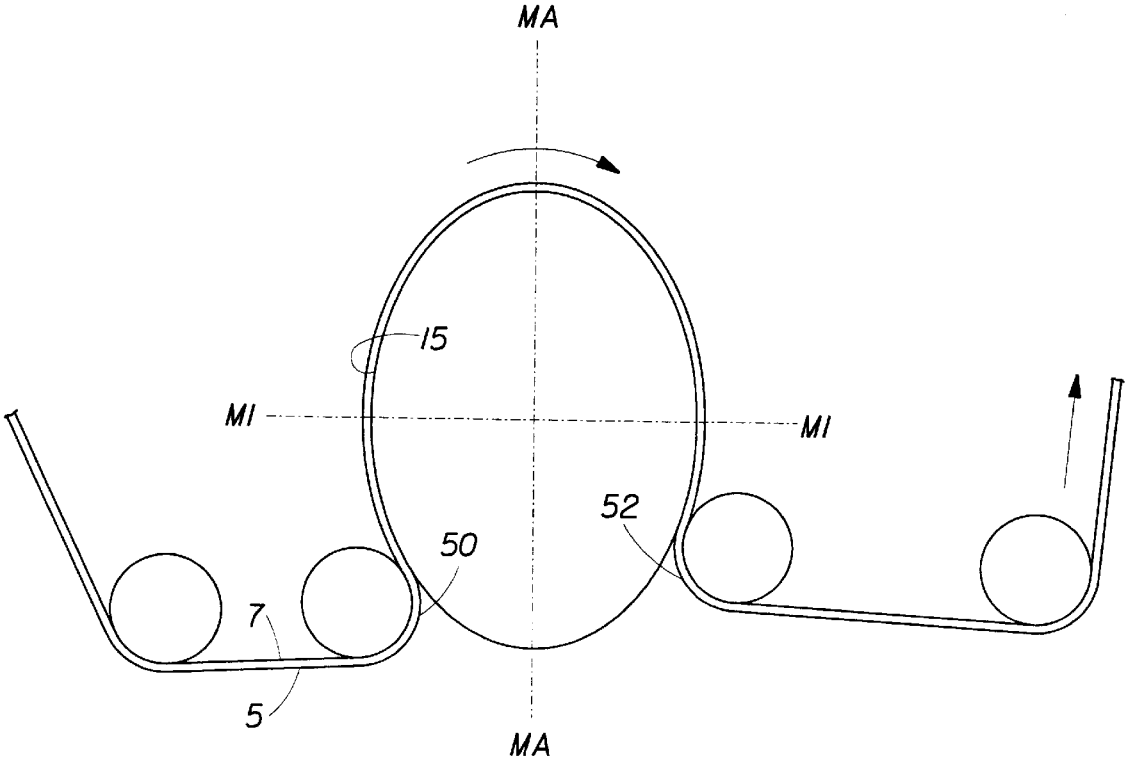
FIG. 1 is a schematic vertical side elevational view of an apparatus according to the present invention having a generally vertically oriented major axis and a stationary micropore drying medium.

Referring to FIG. 1, the micropore drying apparatus 10 according to the present invention comprises at least one, and typically a plurality of, micropore drying media 15. The apparatus 10 is used for drying a web thereon. Each of the at least one micropore drying media 15 preferably comprises one, and preferably a plurality of, plies 22,24,26,28,30,32 superimposed in face-to-face relationship. Such a micropore drying medium 15 is generally planar, and has a Z-direction oriented orthogonal to the plane. The micropore drying apparatus 10 may be executed in a flat geometry or, preferably, is disposed in a curvilinear geometry and adapted to be used in a roll. The apparatus 10 has a machine direction. The web moves in the machine direction relative to the apparatus 10. The micropore drying apparatus 10, and particularly the micropore drying medium 15, have a flow resistance therethrough. The flow resistance varies in a decreasing fashion in the machine direction.

Figure 2:
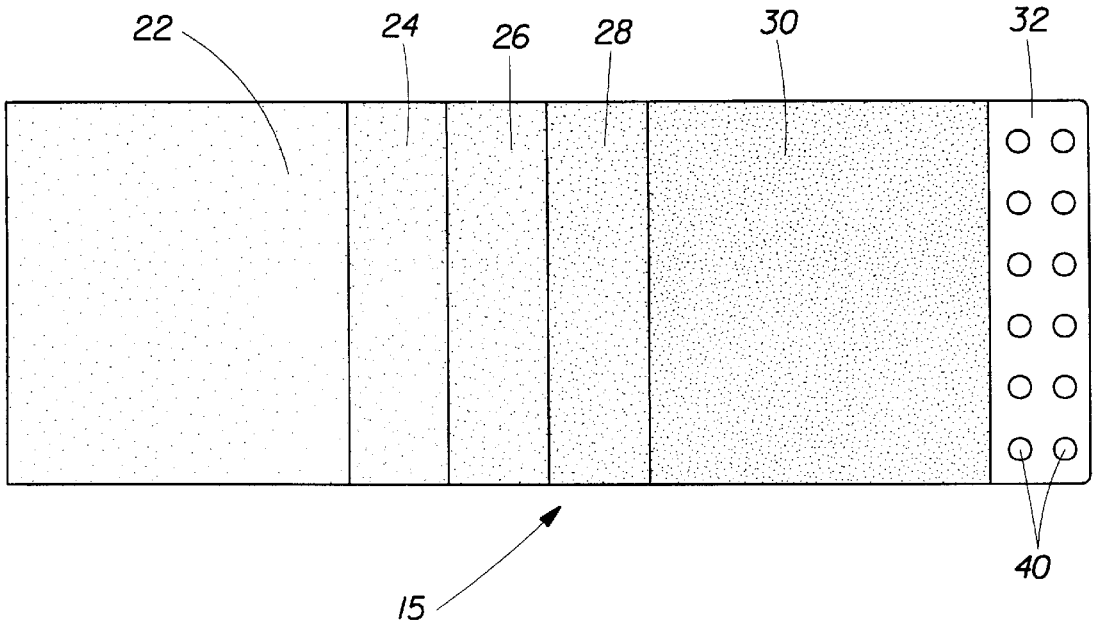
FIG. 2 is a schematic top plan view of a micropore drying medium according to the present invention.

Referring to FIG. 2, as used herein, a micropore drying apparatus 10 is any apparatus 10 which introduces a micropore drying medium 15 in the flow path of the through air drying process, which micropore drying medium 15 has a field of pores 40 disposed in a grid. A plurality of the pores 40 are smaller than the interstitials of the web to be dried in the through air drying process. A suitable micropore drying apparatus 10 includes a laminate of one or more woven mesh screens, wherein at least one of the woven screens has openings, or pores 40, therethrough which are smaller than the interstitials of the web to be dried thereon.

Referring back to FIG. 1, the micropore drying apparatus 10 according to the present invention may be used to dry any web comprising a generally planar sheet material. Webs usable with the micropore drying apparatus 10 include tissue paper 5, synthetic non wovens, hard grades of paper, cloth, etc. The following description will be directed to a web of tissue paper 5, it being understood that the invention is not so limited.

As illustrated in FIG. 2, the micropore drying apparatus 10 according to the present invention may comprise a single integral unit. By integral unit, it is meant that tissue paper 5 disposed on the micropore drying medium 15 of such an apparatus 10 is, or may be, subject to the micropore drying process without substantial interruption during the entire time period the tissue paper 5 is on the micropore drying medium 15.

As illustrated in FIG. 2, the first ply 22 of the plurality of plies 22,24,26,28,30,32 contacts a web of tissue paper 5 disposed thereon. The first ply 22 has pores 40 therethrough, which provide a pore 40 size smaller than at least some of, and preferably smaller than many of, the interstices of the tissue paper 5 disposed thereon. The arrangement having the relatively smaller pore 40 sizes in the first ply 22 provides a limiting orifice for air flow through the first ply 22 and any tissue paper 5 placed thereon. Air may first pass through the tissue paper 5, then through the micropore drying medium 15, vice versa, or a combination thereof as the tissue paper 5 traverses sequentially spaced portions of the micropore drying medium 15. Alternatively, the micropore drying apparatus 10 according to the present invention may comprise a plurality of micropore drying media 15.

Subjacent the first ply 22 is preferably a plurality of plies 22,24,26,28,30,32 of increasing pore 40 size. In a preferred embodiment, five or six plies 22,24,26,28,30,32 of increasing pore 40 size may be utilized to form a unitary laminate comprising the micropore drying medium 15. Each successive ply below the first ply 22 provides less flow resistance and increased strength for the laminate comprising the micropore drying medium 15.

The pore 40 size under consideration is the finest pore 40 size in the micropore drying medium 15, as this provides the maximum resistance to air flow therethrough and controls the flow of air through the micropore drying medium 15 and any tissue paper 5 disposed thereon. The pore 40 sizes of the subjacent plies 24,26,28,30,32 may be constant in the machine direction or, preferably, are variable in the machine direction as described hereinbelow.

Pore 40 size may be measured using a bubble point test method according to SAE Standard ARP 901, incorporated herein by reference. If the micropore drying medium 15 comprises a laminate of plural plies 22,24,26,28,30,32, the micropore drying medium 15 is measured as a unitary laminate. If the micropore drying medium 15 is held stationary, and the web moved relative to the micropore drying medium 15, there are prophetically less fatigue stresses encountered by the micropore drying medium 15.

Flow resistance is measured according to the technique discussed in commonly assigned U.S. Pat. No. 6,021,583, issued Feb. 8, 2000 to Stelljes, Jr. et al., incorporated herein by reference. Specifically, as used herein, flow resistance measures the wet pressure drop through the micropore drying medium 15. A suitably-sized sample of the micropore drying medium 15 is provided so that a round, 4 inch (10.2 cm) diameter portion of the micropore drying medium 15 may be exposed to flow therethrough. A test fixture is also provided. The test fixture comprises pipe having a length of seven inches (17.8 cm) and a 2 inch (5.1 cm) nominal diameter. The pipe is joined to a reducer. The reducer has a length of 16 inches (40.6 cm) and has a two inch (5.1 cm) nominal inside diameter. The inside diameter of the reducer tapers at a 7° included angle over a 16 inch (40.6 cm) length to a four inch (10.2 cm) nominal inside diameter.

The sample of the micropore drying medium 15 is disposed at the four inch (10.2 cm) nominal inside diameter portion of the test fixture. The micropore drying medium 15 is oriented so that the first ply 22 faces the high-pressure (upstream) side of the air flow. The test fixture is symmetrical about the sample of the micropore drying medium 15. Downstream of the sample of the micropore drying medium 15, the test fixture again tapers through a reducer at an included angle of 7° from a four inch (10.2 cm) nominal inside diameter to a two-inch (5.1 cm) nominal inside diameter. This reducer is also joined to a pipe. Such pipe has a length of seven inches (17.8 cm), is straight, and has a two inch (5.1 cm) nominal inside diameter.

800 SCFM per square foot of air flow (377.6 liters per second) per square foot (929 square centimeters) is applied through the micropore drying medium 15 for a total of about 70 SCFM (33.04 standard liters per second) per 0.087 square feet (80.8 square centimeters) for the sample described herein. The air flow is supplied at 75°□2° F. (23.9°□1° C.). The static pressure drop across the micropore drying medium 15 is measured by a manometer, a pair of pressure transducers, or other suitable means known in the art. The static pressure differential is the dry pressure drop for that micropore drying medium 15.

In order to measure wet pressure drop, the apparatus 10 and sample described above are provided. Additionally, a spray nozzle is provided and mounted upstream of the sample of the micropore drying medium 15. The spray nozzle is a Spraying System (Wheaton, Illinois) Type TG full cone spray nozzle (¼ TTG 0.3) with a 0.020 inch (0.05 centimeters) orifice and 100 mesh screen or equivalent. The nozzle is mounted at a distance of 5 inches (12.7 centimeters) upstream of the sample of the micropore drying medium 15. The nozzle supplies 0.06 gallons per minute (227 cubic centimeters per minute) of water at 40 psi (2810 grams per square centimeter) at a 58° full cone spray angle. The water is sprayed at a temperature of 72°□2° F. (22.2°□1° C.). The spray completely covers the sample of the micropore drying medium 15 and increases the pressure drop therethrough. Wet pressure drop is measured at various flow rates. For purposes of determining flow resistance in accordance with the present invention, wet pressure drop is measured at 40 and 80 scfm (18.88 and 37.76 liters per second) per 0.087 square feet (80.8 square centimeters). If the wet flow resistance at either flow rate is less at one point in the machine direction of the micropore drying apparatus 10 than at a preceding section, the wet flow resistance is judged to be less for purposes of the present invention. The wet flow resistance is judged to be less at any point in the machine direction of the micropore drying apparatus 10 if it decreases by at least 5% preferably at least 10% and more preferably at least 20% as measured at any two points spaced apart in the machine direction.

The micropore drying medium 15 of the micropore drying apparatus 10 according to the present invention may be stationary, and arranged in a configuration which allows a papermaking belt 7 and web disposed thereon to be moved relative to the stationary micropore drying medium 15. Suitable stationary configurations for micropore drying media 15 include generally cylindrical geometries and geometries having unequal major and minor axes. If the latter arrangement is selected, preferably the major axis MA—MA is greater than the minor axis MI—MI and disposed in a generally vertical orientation.

If a stationary micropore drying medium 15 is utilized, the tissue paper 5 may be carried on a through air drying belt 7. In such an arrangement, the tissue paper 5 is interposed between a movable through air drying belt 7 and a stationary micropore drying medium 15.

Suitable papermaking belts 7 include through air drying belts 7 as are well known in the art. Preferred through air drying belts 7 are described in commonly assigned U.S. Pat. No. 3,301,746, issued Jan. 31, 1967 to Sanford et al.; U.S. Pat. No. 3,905,863, issued Sep. 16, 1975 to Ayers; U.S. Pat. No. 3,974,025, issued Aug. 10, 1976 to Ayers; U.S. Pat. No. 4,191,609, issued Mar. 4, 1980 to Trokhan; U.S. Pat. No. 4,239,065, issued Dec. 16, 1980 to Trokhan; U.S. Pat. No. 5,366,785 issued Nov. 22, 1994 to Sawdai; and U.S. Pat. No. 5,520,778, issued May 28, 1996 to Sawdai; U.S. Pat. No. 4,514,345, issued Apr. 30, 1985 to Johnson et al.; U.S. Pat. No. 4,528,239, issued Jul. 9, 1985 to Trokhan; U.S. Pat. No. 5,098,522, issued Mar. 24, 1992; U.S. Pat. No. 5,260,171, issued Nov. 9, 1993 to Smurkoski et al.; U.S. Pat. No. 5,275,700, issued Jan. 4, 1994 to Trokhan; U.S. Pat. No. 5,328,565, issued Jul. 12, 1994 to Rasch et al.; U.S. Pat. No. 5,334,289, issued Trokhan et al.; U.S. Pat. No. 5,431,786, issued Jul. 11, 1995 to Rasch et al.; U.S. Pat. No. 5,496,624, issued Mar. 5, 1996 to Stelljes, Jr. et al.; U.S. Pat. No. 5,500,277, issued Mar. 19, 1996 to Trokhan et al.; U.S. Pat. No. 5,514,523, issued May 7, 1996 to Trokhan et al.; U.S. Pat. No. 5,554,467, issued Sep. 10, 1996, to Trokhan et al.; U.S. Pat. No. 5,566,724, issued Oct. 22, 1996 to Trokhan et al.; U.S. Pat. No. 5,624,790, issued Apr. 29, 1997 to Trokhan et al.; U.S. Pat. No. 5,628,876 issued May 13, 1997 to Ayers et al.; U.S. Pat. No. 5,679,222 issued Oct. 21, 1997 to Rasch et al.; and U.S. Pat. No. 5,714,041 issued Feb. 3, 1998 to Ayers et al., the disclosures of which are incorporated herein by reference. Yet other papermaking belts 7 are disclosed in U.S. Pat. No. 5,429,686 issued Jul. 4, 1995 to Chiu et al. and U.S. Pat. No. 5,672,248 issued Sep. 30, 1997 to Wendt et al.

The micropore drying medium 15 according to the present invention may provide for a residence time thereon of at least 1, preferably at least 25, and more preferably at least 250 milliseconds, but not more than 10,000, preferably not more than 5,000, and more preferably not more than 1,000 milliseconds. If desired, the micropore drying medium 15 may comprise multiple zones of differing pressures, as described in the aforementioned patents incorporated herein by reference. The micropore drying medium 15 according to the present invention may have a length ranging from 5 millimeters to 50 meters. with a preferred length of about 4 to about 30 meters, in order to provide adequate residence time.

The plies 22,24,26,28,30,32 of the micropore drying medium 15 may be joined together to form a unitary support for the tissue paper 5 as follows. The first ply 22 is optionally calendered and the subjacent plies 24,26,28,30,32 are preferably individually calendered. The calendering must be sufficient to provide adequate knuckle area for the sintering operation described below. The calendering must not unduly reduce the open area of the pores 40. The calendering may reduce the thickness of each ply 22, 24, 26, 28, 30 to approximately 65–85% of its original thickness. A considerable range of calendering levels may be utilized to provide the desired knuckle area.

The plies 22, 24, 26, 28, 30, 32 are then superimposed upon each other in the desired arrangement. As noted above, preferably but not necessarily, the plies 22, 24, 26, 28, 30, 32 are monotonically arranged in order from the smallest pore 40 size to the largest pore 40 size to form a laminate. Table I below shows a preferred six-ply arrangement. This arrangement illustrates a preferred embodiment of one laminated micropore drying medium 15 suitable for use as the first micropore drying medium 15 which the tissue paper 5 to be dried encounters during the drying process.

TABLE I

| Ply | Warps/Shutes per 2.54 cm for plies 1–5 Perf Plate/Hole Size/Pitch for Ply 6 | Warp/Shute diameter (cm) for plies 1–5. Perf Plate Thickness for Ply 6. | Weave |
|---|---|---|---|
| 1 | 165 × 1400 | 0.0071/0.0041 | Dutch Twill |
| 2 | 150 × 150 | 0.0066 | Square |
| 3 | 60 × 60 | 0.0191 | Square |
| 4 | 30 × 30 | 0.0406 | Square |
| 5 | 16 × 16 | 0.0711 | Square |
| 6 | 1.65 mm diameter holes on a 2.77 mm pitch | 24 gauge ss | None |

In a preferred embodiment, the micropore drying apparatus 10 according to the present invention may have three sections, each of decreasing flow resistance. Successive sections may be provided with a relatively coarser first ply 22. The second through sixth ply 32 may be the same in all three sections of mutually differing flow resistances. Table IIA below illustrates three different suitable embodiments of the first ply 22. The successive numbers below indicate the successive positions in the machine direction in which the micropore media 15 of the micropore drying apparatus 10 having the specified first ply 22 may be disposed. Position 1 in the Table below precedes Position 2 which precedes Position 3 as the positions are taken in the machine direction. Thus, the tissue paper 5 will encounter positions 1, 2, 3, respectively, in that order.

TABLE IIA

| Position of First Ply | Warps/ Shutes per 2.54 cm in the the First Ply | Warp/Shute diameter (cm) | Weave | Pore Density (pores per square centimeter × $10^{-5)}$ | Pore Size (microns) |
|---|---|---|---|---|---|
| 1 | 325 × 2300 | 0.0038/0.0025 | Dutch Twill | 2.9 | 7–8 |
| 2 | 165 × 1400 | 0.0071/0.0041 | Dutch Twill | 0.89 | 15–18 |
| 3 | 80 × 700 | 0.0102/0.0076 | Dutch Twill | 0.22 | 34–36 |

Specific examples of weaves usable in accordance with the first ply 22 of the present invention are shown in Table IIB below. Each of the first ply 22 shown in Table IIB is made with a Dutch Twill weave.

TABLE IIB

| Mesh Count (warps/shutes per 2.54 cm) | Pore Density (pores per square centimeter × $10^{-5}$) | Pore Size (microns) |
|---|---|---|
| 510 × 3600 | 7.1 | 4.5 |
| 325 × 2300 | 2.9 | 7.5 |
| 260 × 2000 | 2.0 | 9.3 |
| 165 × 1400 | 0.89 | 15 |
| 130 × 900 | 0.45 | 23 |
| 80 × 700 | 0.22 | 35 |
| 24 × 300 | 0.03 | 117 |

The micropore drying apparatus 10 according to the present invention may have a pore 40 size which is variable in, and which preferably increases in, the machine direction. The increasing pore 40 size may be provided by having different first ply 22 joined to each other in abutting relationship. The plies 22,24,26,28,30,32 may be sequenced without interruption, except for the means used to sequentially join each first ply 22 to the succeeding plies 24,26, 28,30,32. The plies 22,24,26,28,30,32 may be joined together using any known means, including a full penetration tungsten weld or panels bolted into place. Alternatively, the first ply 22 may be abutted in end-to-end relationship, with each first ply 22 being joined to subjacent plies 24,26, 28,30,32 as described above. The subjacent plies 24,26,28, 30,32 may be joined together using welding or other means known in the art. If the micropore drying medium 15 is held stationary, by abutting adjacent first ply 22 together with a joining technique which does not involve the first ply 22, interruption in the air flow therethrough, and hence adverse effects on the drying rate can be minimized. Prophetically a bolted construction can be used instead of a welded construction if the micropore media 15 is held stationary.

In another execution, the micropore drying medium 15 may be movable in the machine direction. In such an embodiment, preferably the micropore drying medium 15 is disposed as or on the cover of an axially rotatable roll, as is known and illustrated in the art. The axially rotatable roll carries the tissue paper 5 thereon. Optionally, a through air drying belt 7 thereon. The tissue paper 5 and/or through air drying belt 7 may be utilized. The tissue paper 5 and/or through air drying belt 7 do not move relative to the cover of the axially rotatable roll while it is rotating to minimize tearing of the tissue papers 5.

Figure 3:
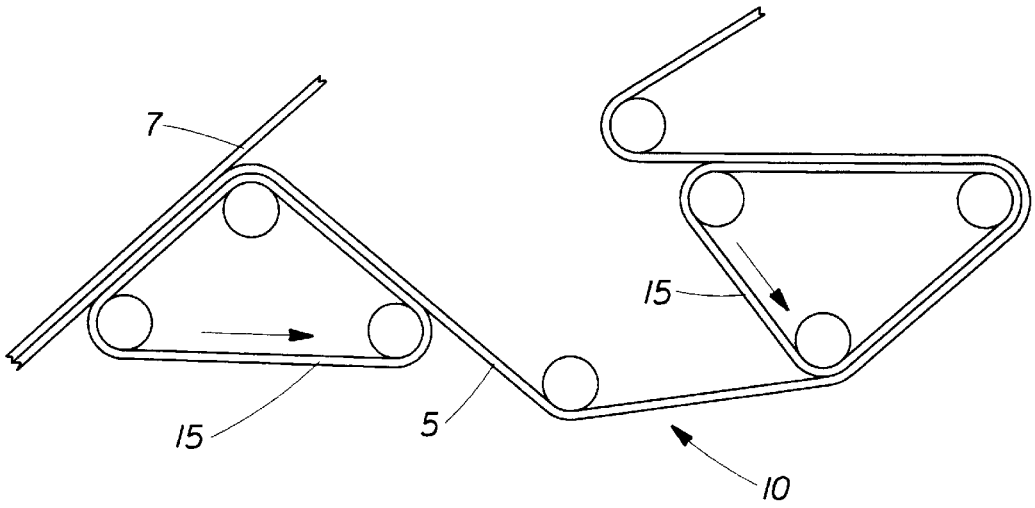
FIG. 3 is a schematic side elevational view of a micropore drying apparatus according to the present invention having first and second discrete units, the first discrete unit being somewhat larger than the second. An optional through air drying belt carries the Web to be dried to the first unit.

Referring to FIG. 3, the micropore drying apparatus 10 may comprise two or more discrete units instead of a single integral unit. By discrete units, it is meant that each unit is, of itself, an integral unit. However, the two discrete units are mutually separate and spaced apart in the machine direction. At the space between the discrete units, the tissue paper 5 is not subjectable to the micropore drying process.

If a plurality of discrete units are selected for the micropore drying apparatus 10 according to the present invention, first and second discrete units, or any number of successive discrete units, may be provided. Each discrete unit is spaced apart in the machine direction from the preceding discrete unit. Each successive discrete unit preferably has larger pores 40 than that of the preceding discrete unit.

The execution of FIG. 3 illustrates a movable micropore drying medium 15. The movable micropore drying medium 15 is in the form of an endless belt comprising a closed loop. Two discrete units are provided. The first discrete unit illustrates the optional through air drying belt 7. The through air drying belt 7 and the first unit of the micropore drying medium 15 are juxtaposed such that the tissue paper 5 to be dried is interposed therebetween.

One of ordinary skill will recognize that the through air drying belt 7 may further transport the tissue paper 5 to be dried closer to the second discrete unit prior to transfer. Alternatively, and perhaps preferably, the through air drying belt 7 may carry the tissue paper 5 to be dried entirely throughout the second discrete unit of the micropore drying apparatus 10.

One of ordinary skill will recognize that the execution of FIG. 3, having first and second discrete units, may comprise two axially rotatable rolls. The first axially rotatable roll is usable as the first discrete unit, while the second axially rotatable roll is usable as the second discrete unit. Using axially rotatable rolls as the micropore drying apparatus 10 of the present invention provides the benefit of ease of construction and a micropore drying medium 15 which moves in tandem with the tissue paper 5 to be dried.

Of course, it will be recognized by one of ordinary skill that a second micropore drying medium 15 may be disposed in face-to-face relationship with the backside of the through air drying belt 7. This arrangement provides the benefit that the through air drying belt 7 may be separately dewatered, preventing rewet of the tissue paper 5.

In a hybrid arrangement, the pore 40 size may be variable within one or more discrete units of the micropore drying apparatus 10. The largest pore 40 size of a first discrete unit may be matched to, larger than or smaller than the smallest pore 40 size of a second or succeeding discrete unit, and so on. Preferably, the largest pores 40 of the first discrete unit are slightly smaller than or the same size as the smallest pores 40 of the second discrete unit in order to efficiently remove mechanically bound water. It is to be recognized that variations in both residence time and pore 40 sizes may be utilized with any of the foregoing arrangements.

If desired, at least one of the discrete units of the micropore drying apparatus 10 may comprise pores 40 which are smaller than the interstices of the tissue paper 5. Further, such pores 40 may have a vacuum applied thereto, which vacuum is provided at a pressure less than the breakthrough pressure of the pores 40. Such a discrete unit may be made according to the teachings of commonly assigned U.S. Pat. No. 4,556,450, issued 1985 to Chuang et al., or U.S. Pat. No. 5,584,126, issued Dec. 17, 1996 to Ensign et al., and incorporated herein by reference.

For the embodiments described and claimed herein, the smallest pores 40 of the micropore drying apparatus 10, whether comprised of a single integral unit or a plurality of discrete units, may range from a lower limit of at least 1, and preferably at least 5 microns to an upper limit of 20, and preferably an upper limit of 10 microns. The largest pores 40 of the micropore drying apparatus 10 according to the present invention again, whether comprised of a single integral unit or a plurality of discrete units, may range from a lower limit of at least 20, and preferably at least 30 microns to an upper limit of not more than 120, and preferably not more than 40 microns.

Additionally, the decrease in flow resistance of the micropore drying apparatus 10 which occurs in the machine direction may be provided by increasing the density of the pores 40 in one or more micropore drying media 15. By density or pore 40 density, it is meant the number of pores 40 through the first, or most restrictive, ply of the micropore drying medium 15 per unit area. As the pore 40 density, or number of pores 40 per unit area of micropore drying medium 15, increases at constant pore size, greater air flow will occur for a given area of the micropore drying medium 15 and wet flow resistance will be decreased. For the variable pore 40 size embodiments described herein, the first ply 22 of the micropore drying media 15 may have the pore 40 density and pore 40 size listed in Table III for the first, second and third positions of the first ply 22 of the micropore drying medium 15.

TABLE III

| Position of First Ply | Pore Density (pores per square centimeter × $10^{-5}$) | Pore Size (microns) |
|---|---|---|
| 1 | 2.0–7.1 | 4.5–9.3 |
| 2 | 0.45–2.0 | 9.3–23 |
| 3 | 0.03–0.45 | 23–117 |

If desired, the mesh count and wire size of such a micropore drying medium 15 may be adjusted to achieve constant pore 40 size.

Of course, while embodiments having three successive positions in the machine direction are described, it is to be realized that embodiments having any number of positions may be utilized for the micropore drying apparatus 10 of the present invention. The positions may be contiguous or may be spaced apart in the machine direction. Preferably, the wet flow resistance monotonically decreases in each successive section, however, it is possible that in a less preferred embodiment, certain sections may be of increasing wet flow resistance.

If a tissue paper 5 has low and high density regions, as described above, the sizes of the pores 40 may be optimized relative to the sizes of the interstitials of the low and high density regions of the tissue paper 5. Typically, the low density regions have larger sized interstitials than the high density regions. The sizes of the interstitials are distributed in a normal distribution, commonly measured as a pore volume distribution. Pore volume 10 distribution is measured by a Pore Volume Distribution Analyzer, made by TRI of Princeton, N.J.

For example, a micropore drying apparatus 10 having three sections. each of decreasing flow resistance, may be provided. The pore 40 size of the first ply 22 in the first section may be less than the size of the midpoint of the pore volume distribution of the interstitials of the high density regions in the tissue paper 5. The pore 40 size of the first ply 22 in the second section may range from approximately the size of the midpoint of the pore volume distribution of the interstitials in the high density region to approximately the midpoint of the pore volume distribution of the interstitials of the low density regions. The pore 40 size of the first ply 22 in the third section may approximate the midpoint of the size of the interstitials in the low density region.

Alternatively, decreasing flow resistance in the machine direction may be accomplished by providing successive micropore drying media 15 with an intrinsically lesser wet flow resistance. For example, successive micropore drying media 15, or successive portions of a single micropore drying medium 15, may be treated with or made of, a material having an inherently lesser surface energy. For example, one or more micropore drying media 15, and particularly the surface of the pores 40 which provide the limiting flow path through the micropore drying media 15, may be treated with low surface energy extruded plastics such as polyesters or polypropylenes or the micropore drying medium 15 may be woven from such materials. Alternatively, the micropore drying media 15 may be treated with a dry film uniform coating of silicone. Any means which reduces the flow resistance through the micropore drying medium 15 is considered to be suitable.

Further information on such coatings and reducing the surface energy of the micropore drying media 15 may be found in commonly assigned U.S. Pat. No. 5,912,072, issued Jun. 15, 1999 to Trokhan et al., and U.S. Pat. No. 6,021,583, issued Feb. 8, 2000 to Stelljes, Jr. et al., both previously incorporated herein by reference.

Additionally, one of ordinary skill will recognize there are other ways to decrease the flow resistance in various parts of the micropore drying medium 15 according to the present invention. For example, the first ply 22 of the micropore drying medium 15 may be provided with pores 40 therethrough having a less tortuous flow path. For example, the Z-direction dimension of the pores 40 could become straighter or shorter. Alternatively, the flow resistance through the pores 40 of the first ply 22 may be impacted by the hydraulic radius of the pores 40. As the hydraulic radius of the pores 40 increases, the flow resistance therethrough will likewise decrease.

Optionally, a stationary micropore drying apparatus 10 may have a cover therearound. The cover rotates with, and preferably at the same surface speed as, the tissue paper 5 to be dried thereon. If such a rotatable cover is used, preferably the cover has pores 40 larger than the interstitials in the tissue paper 5 to be dried, so that the flow restriction still occurs at the stationary micropore drying medium 15. This arrangement provides the benefit that, if desired, air flow may be drawn in through the web and into the interior of the micropore drying apparatus 10. Alternatively, the micropore drying apparatus 10 may blow air out through the micropore drying medium 15 and then through the web.

If the micropore drying medium 15 is deployed as a stationary cover, it may be utilized on a roll having a noncircular profile. The profile of the roll is taken orthogonal to the machine direction. The profile of the roll may be flat, elliptical as shown, and have a major axis MA—MA greater than the minor axis MI—MI. If the major axis MA—MA is generally vertically oriented, as illustrated, a smaller footprint will be necessary to accommodate a micropore drying medium 15 of increased residence time. Alternatively, the micropore drying medium 15 having a noncircular profile may be executed in the form of an endless loop and be movable in the machine direction.

If desired, a roll may be used to lightly press the web against the micropore drying medium 15. A roll to lightly press the web against the micropore drying medium 15 may be disposed at the first zone of the micropore drying apparatus 10, the second zone of the micropore drying apparatus 10, or both. Lightly pressing a web against a roll is generally described in U.S. Pat. Nos. 5,598,643; 5,701,682; and 5,772,845.

In the description of the invention, various embodiments and/or individual features are disclosed. All combinations of such inventions and features are possible and can result in preferred executions of the invention.

What is claimed is:

1. A micropore drying apparatus having a machine direction and a Z-direction orthogonal thereto, the micropore drying apparatus being permeable to air flow therethrough, the micropore drying apparatus having a wet flow resistance to air flow therethrough, the wet flow resistance to air flow decreasing in the machine direction.

2. A micropore drying apparatus according to claim 1, wherein the micropore drying apparatus comprises a micropore drying medium having pores therethrough, wherein the size of the pores increase in the machine direction.

3. A micropore drying apparatus according to claim 1, wherein said micropore drying apparatus comprises a micropore drying medium having pores therethrough, the pores having a pore density, the pore density increasing in the machine direction.

4. A micropore drying apparatus comprising a micropore drying medium having a Z direction and a machine direction orthogonal thereto, the micropore drying medium comprising a single integral unit having pores therethrough, the pores having a pore density, the micropore drying medium having a wet flow resistance to air flow therethrough, the wet flow resistance to air flow decreasing in the machine direction.

5. A micropore drying apparatus according to claim 4, wherein the size of the pores increases in the machine direction.

6. A micropore drying apparatus according to claim 4, wherein the micropore drying medium is stationary.

7. A micropore drying apparatus according to claim 4, wherein the pore density increases in the machine direction.

8. A micropore drying apparatus having a Z-direction and a machine direction orthogonal thereto, the micropore drying apparatus comprising a plurality of micropore drying media having at least a first unit and a second unit discrete therefrom, the second unit being spaced apart from the first unit in the machine direction, each of the first and second units comprising a micropore drying media having pores therethrough each unit having a pore density and having a wet flow resistance to air flow therethrough, wherein the wet flow resistance of the second unit is less than the wet flow resistance of the first unit.

9. A micropore drying apparatus according to claim 8, wherein the first unit has pores of a first size and the second unit has pores of a second size, the pores of the second unit having a greater size than the pores of the first unit.

10. A micropore drying apparatus according to claim 8, wherein at least one of the first and second units is axially rotatable.

11. A micropore drying apparatus according claim 10, comprising a first axially rotatable unit and a second axially rotatably unit, each of the first and second axially rotatable units having pores therethrough, each of the first and second units having a respective differential pressure applied across the pores, the differential pressure across the first unit being less than the breakthrough pressure of the pores, the differential pressure across the second unit being greater than the breakthrough pressure of the pores.

12. A micropore drying apparatus according to claim 8, wherein the pore density of the second unit is greater than the pore density of the first unit.

13. A process for drying a generally planar sheet material, the generally planar sheet material being movable in a machine direction, the process comprising the steps of:

providing a micropore drying apparatus, the micropore drying apparatus comprising one or more micropore drying media, the at least one or more micropore drying media comprising at least one micropore drying medium having pores therethrough, the pores having a wet flow resistance associated therewith allowing air flow therethrough;

disposing the generally planar sheet material upon the micropore drying medium;

passing air through the generally planar sheet material and the micropore drying medium, wherein the pores provide wet flow resistance to the air flow therethrough greater than the wet flow resistance of the generally planar sheet material;

moving the generally planar sheet material in the machine direction, whereby the generally planar sheet material contacts different pores of the micropore drying medium, wherein the downstream pores contacted by the generally planar sheet material have a lesser wet flow resistance than the upstream pores.

14. A process according to claim 13, wherein the generally planar sheet material comprises a tissue paper.

15. A process according to claim 14, wherein the generally planar sheet material comprises a tissue paper having regions of multiple density.

16. A process according to claim 14, wherein the step of providing a micropore drying medium comprises providing a micropore drying medium having three different sections, each section having pores therethrough, the pores of each section having a pore size, each section's pore size being greater than that of the immediately preceding section, and wherein the tissue paper has high density regions having interstitials sized in a first normal pore volume distribution and a low density region having interstitials sized in a second normal pore volume distribution wherein the pore size of the first section is less than the midpoint of the pore volume distribution of the high density region of the tissue paper.

17. A process according to claim 16, wherein the pore size of the second section ranges from approximately the midpoint of the pore volume distribution of the interstitials of the high density region of the tissue paper to approximately the midpoint of the pore volume distribution of the interstitials of the low density region.

18. A process according to claim 17, wherein the pore size of the third section is approximately the midpoint of the pore volume distribution of the interstitials of the low density regions.

19. A process according to claim 14, further comprising the step of lightly pressing the generally planar sheet material against the micropore drying medium.

* * * * *